United States Patent [19]

Loeffler

[11] 4,174,056

[45] Nov. 13, 1979

[54] PUMP TYPE DISPENSER WITH CONTINUOUS FLOW FEATURE

[75] Inventor: Herbert H. Loeffler, Arlington, Mass.

[73] Assignee: Ciba-Geigy Corporation, Ardsley, N.Y.

[21] Appl. No.: 795,553

[22] Filed: May 10, 1977

[51] Int. Cl.[2] ..... B05B 11/02

[52] U.S. Cl. ..... 222/321; 222/341; 239/321; 239/333; 417/541; 417/552

[58] Field of Search ..... 239/331, 333, 321; 222/321, 340, 384, 385, 341, 383; 417/541, 566, 552

[56] References Cited

U.S. PATENT DOCUMENTS

| | | | |
|---|---|---|---|
| 3,061,202 | 10/1962 | Tyler | 239/333 |
| 3,161,329 | 12/1964 | Fedit et al. | 239/333 X |
| 3,399,836 | 9/1968 | Pechstein | 239/333 |
| 3,746,260 | 7/1973 | Boris | 222/385 X |
| 3,923,250 | 12/1975 | Boris | 239/321 |
| 4,079,865 | 3/1978 | Kutick | 239/333 |

FOREIGN PATENT DOCUMENTS

| | | | |
|---|---|---|---|
| 1363409 | 5/1964 | France | 239/333 |
| 2165571 | 8/1973 | France | 239/333 |

*Primary Examiner*—Robert B. Reeves
*Assistant Examiner*—Michael J. Forman
*Attorney, Agent, or Firm*—Wenderoth, Lind & Ponack

[57] ABSTRACT

A pump type dispenser for dispensing a spray of liquid has a container for containing the liquid to be dispensed, a piston-cylinder device for drawing liquid out of the container and pressurizing it, a dispensing head into which the pressurized liquid is pumped, with a free piston chamber therein in which is a free piston spring loaded toward the direction from which the pressurized liquid comes, and a nozzle opening out of the free piston chamber through the dispensing head. A check valve between the piston-cylinder device and the free piston chamber blocks return of the fluid once it has been forced into the free piston chamber, so that the free piston acts on the liquid in the free piston chamber to dispense it in a spray through the nozzle while the piston-cylinder device recovers from its actuated to its unactuated position and the next actuation thereof is started.

2 Claims, 7 Drawing Figures

PUMP TYPE DISPENSER WITH CONTINUOUS FLOW FEATURE

This invention relates to a finger pump atomizer, and more particularly to an atomizer of this type in which a spray of liquid is dispensed from the atomizer only after sufficient pressure has been built up to provide proper atomization.

BACKGROUND OF THE INVENTION AND PRIOR ART

Finger pump type atomizers for dispensing a spray of liquid have been known in the prior art. They are widely used for dispensing liquids from containers, such as window cleaning preparations, air fresheners, and the like. However, in order to reduce the cost of such finger pump atomizers, it has been the conventional practice to use so-called mechanical break-up atomizing means. These are normally very simple nozzle structures, which, unless the fluid supplied thereto is at sufficient pressure, do not do a very good job of atomizing the liquid.

The finger pump atomizers according to the prior art generally provide pressure on the liquid to be dispensed only when the device is actuated by finger pressure. Unless the device is properly actuated, insufficient pressure is generated and the spray will not be properly atomized at the start or at the end of the dispensing operation, and under the most unfavorable conditions, the spray will be unsatisfactory throughout the actuation of the device.

In order to overcome this problem, there has been proposed in U.S. Pat. No. 3,399,836 a finger pump atomizer in which the parts are arranged to start the dispensing of the liquid only after pressure has been built up during the stroke of the pump plunger. Spring means and a piston are provided within the pump atomizer structure for exerting pressure on the liquid to be dispensed, in combination with the pressure exerted by the movement of the pump plunger.

However, this device is relatively complicated, particularly with respect to the valving for the release of the liquid under pressure after the pressure has been built up. Other dispenser, such as those shown in U.S. Pat. Nos. 3,746,260 and 3,923,250, have spring loaded pistons with elongated valve members thereon extending into the nozzle of the dispenser to keep the nozzle closed until pressure of the liquid to be dispensed acting on the piston withdraws the elongated valve member from the nozzle. When the pressure falls, the spring urges the piston toward the nozzle to close the nozzle. While these dispensers avoid some of the drawbacks of the more complicated device, they still have the drawback that a valve member must be provided on the piston, and the piston must reciprocate substantially in line with the nozzle. Moreover, the above-described devices will dispense liquid only at the time of depression of the pump plunger. They are not able to maintain pressure on the liquid drawn out of the reservoir of liquid to be dispensed, so as to continue dispensing the liquid even, after the pump plunger has been actuated quickly a number of times, when the pump plunger is returning to its initial position to start the next stroke. Only one quantity of the liquid can be dispensed for each depression of the plunger knob.

It would be a distinct advance in the art to have a finger pump atomizer which would start dispensing of the liquid only after a predetermined pressure has been built up on the liquid and would cut off dispensing of the liquid after the pressure falls below the predetermined pressure, yet which is a relatively simple and inexpensive device to build and in which the cutoff member does not have to reciprocate in alignment with the nozzle. Further technical progress in the art would be achieved by the provision of such a finger pump atomizer which could be modified so as to continue to dispense a spray of liquid after one actuation of the plunger has been completed and until the plunger has recovered and can be actuated again.

OBJECTS AND BRIEF SUMMARY OF THE INVENTION

It is accordingly an object of the present invention to provide a simple pump atomizer which has a simple piston structure which will release a spray of liquid to be dispensed only after a build up of pressure on the liquid to a predetermined value and which will cut off the spray of liquid when the pressure falls below the predetermined pressure.

It is a further object of the present invention to provide a simple pump atomizer in which the device can be actuated a plurality of times so as to dispense a spray of liquid and at the same time store liquid under pressure, so that during the operation of the device, the stored liquid will continue to be dispensed while the device recovers from the actuated condition and is actuated again.

These objects are achieved according to the present invention by the provision of a pump atomizer for dispensing a spray of liquid from a container, comprising a container for containing the liquid to be dispensed, a pump body member, a pump plunger member movable relative to said pump body member, one end of said pump plunger member and said pump body member cooperating to define therebetween a piston-cylinder means, spring means between said members urging them apart, said pump body member having a liquid flow path therethrough having one end communicating with the container and the other end communicating with the piston-cylinder means, a check valve in said liquid flow path for blocking flow of liquid in said liquid flow path in the direction toward said container, a dispensing head having a free piston chamber therein, a pressurized liquid flow path from said piston-cylinder means into one end of said free piston chamber, a free piston slidable in said free piston chamber, a free piston spring in said free piston chamber urging said free piston toward and into engagement with said one end of said free piston chamber, and nozzle means opening out of said free piston chamber through said dispensing head member from a position just above said one end of said free piston chamber, said free piston in the position in engagement with said one end of the free piston chamber obturating the fluid flow between said pressurized liquid flow path and said nozzle means.

A further check valve can be provided in the pressurized liquid flow path which during repeated actuations of the dispenser in close succession, will cause liquid under the pressure of the free piston and free piston spring to continue to be dispensed through the nozzle means during the time the plunger is returned to its unactuated position and until it can be actuated again.

The dispensing head can be made integral with the pump plunger, or the pump plunger can be movable relative to a fixed pump body having the dispensing head forming a part thereof. The piston-cylinder means can also be entirely separate from the dispensing head and be connected thereto only by a tube for the pressurized liquid.

BRIEF DESCRIPTION OF THE FIGURES

Other and further objects of the present invention will become apparent from the following detailed description thereof, taken together with the accompanying drawings, in which.

DETAILED DESCRIPTION OF THE FIGURES

Figure 1:
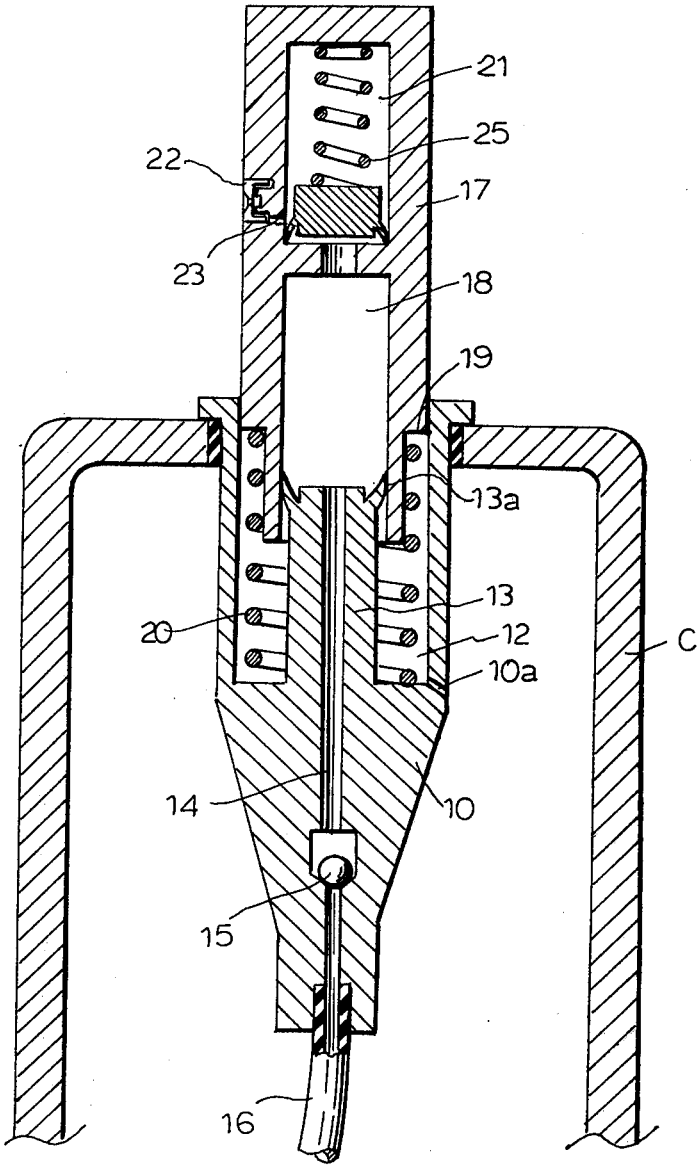
FIG. 1 is a sectional elevation view of a first embodiment of the finger pump atomizer according to the present invention with the parts in the inoperative or rest positions.
Figure 2:
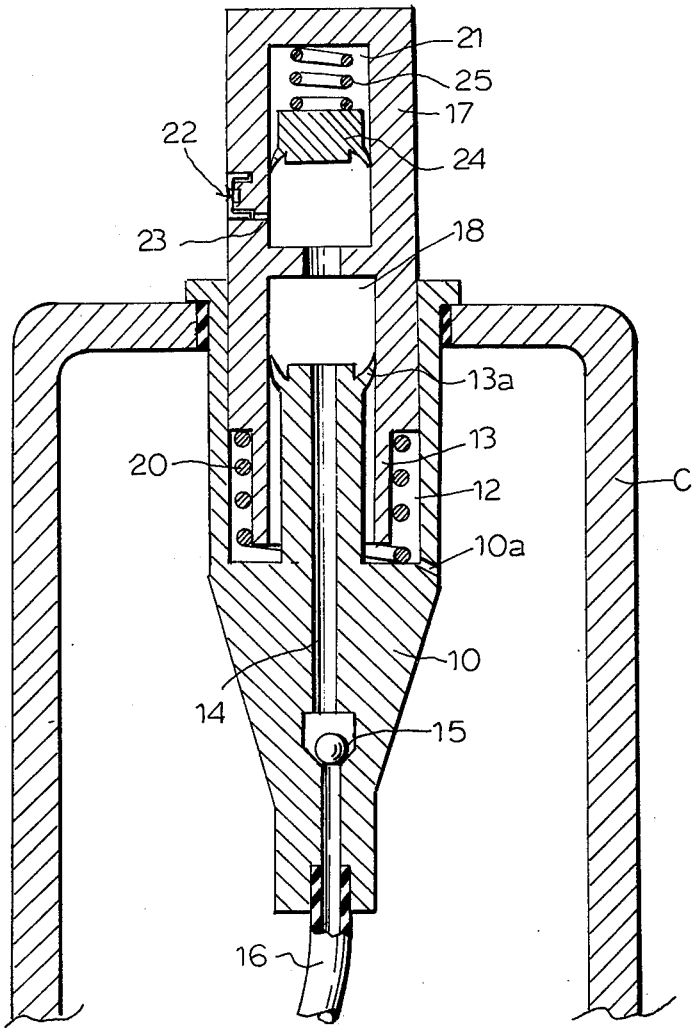
FIG. 2 is a view similar to FIG. 1 with the parts in the dispensing positions.

Referring to FIGS. 1 and 2 showing the first embodiment of the present invention, the pump type atomizer of the present invention is mounted in the mouth of a container generally indicated at C. A pump body 10 has a flange 11 around the upper end thereof engaging over the edge of the opening in the container C to retain the atomizer in the container. Within the pump body 10 is an upwardly opening hollow recess 12 in the center of which is an upwardly extending piston 13 with a gasket **13*a* on the upper end thereof. Extending axially of the pump body 10 from within the container to without the container is a liquid flow bore 14 having intermediate the length thereof a check valve 15 for blocking flow in the direction from without the container to within the container. A dip tube 16 is attached to the bottom of the pump body 10, and extends generally to the bottom of the container C. The body 10 also has an air return opening 10*a* opening from the recess 12** into the container C.

A pump plunger 17 is slidably mounted in the hollow recess 12, and has a downwardly opening cylinder space 18 therein into which the gasket **13*a* of the piston 13 fits in fluid tight sealing engagement. A shoulder 19 is provided around the outside of the pump plunger 17, and a spring 20 is provided between the shoulder 19 and the bottom of the hollow recess 12. The upper portion of the pump plunger 17 constitutes a dispensing head, and within this dispensing head is a free piston chamber 21 within which is freely slidable a free piston 24. An aperture 18*a* is provided between the free piston chamber 21 and cylinder space 18. A free piston spring 25 is positioned between the free piston 24 and the upper end of the piston chamber 21. The free piston spring 25 urges the free piston 24 toward the end of piston chamber 21 having aperture 18*a* therein, and when there is no pressure in the cylinder space 18, the free piston 21** is urged into contact with said end of the free piston chamber.

Opening laterally from the piston chamber 21 slightly above the lower end thereof is a dispensing bore 23 which is smaller than aperture **18*a* and a mechanical break-up nozzle 22 is provided in the peripheral surface of the pump plunger 17 into which the dispensing bore 23** opens.

In the non-dispensing or rest positions of the parts as shown in FIG. 1, the pump plunger 17 is positioned within shoulder 19 just below the flange 11 of the pump body 10 with the spring 20 being substantially fully extended. The free piston 24 is resting at the lower end of the free piston chamber 21 under a slight pressure from the piston spring 25 and acting by itself obturates the liquid passage between aperture **18*a* and bore 23**.

To operate the atomizer the first time, the atomizer must first be primed. This is accomplished by exerting a downward pressure on the pump plunger 17, for example by the finger of the user, and then releasing the pump plunger. At the bottom of the stroke of the pump plunger 17, the parts will be in positions generally similar to those shown in FIG. 2. Since the interior of the atomizer will be filled with air if it has not been used, the first stroke of the pump plunger 17 causes the pump plunger 17 to move downwardly around the piston 13 so as to compress the air within the cylinder space 18. This raises the free piston 24 sufficiently to allow the air to escape through the dispensing bore 23 and the mechanical break-up nozzle 22.

Naturally, the increased air pressure within the cylinder space 18 is transmitted to the check valve 15 to hold the check valve closed, thus preventing compressed air from passing downwardly through the dip tube into the interior of the container C.

Upon the release of the pump plunger 17 in the priming stroke, the pressure within the cylinder space 18 is immediately relieved, and the free piston 24 is moved to the bottom of the piston chamber 21 by the action of the spring 25, thus closing off the communication between the dispensing bore 23 and the cylinder space 18. Further upward movement of the pump plunger 17 under the effect of the expanding spring 20 will create a vacuum within the space 18, thus causing the check valve 15 to open and liquid will be drawn up through the dip tube 16, past the check valve 15, and into the cylinder space 18.

The device is now primed and ready for use. Once it has been primed it will normally remain primed for a long period of time after use, and if the parts are sufficiently closely fitted, should hold its prime indefinitely.

In order to dispense liquid, finger pressure is again exerted on the pump plunger 17, and when the pump plunger has been depressed to its full extent, the parts are in the positions shown in FIG. 2. Again, the start of downward movement of the pump plunger 17 will create a force on the liquid within the cylinder space 18, closing the check valve 15. A further increase in pressure will start the free piston 24 rising against the resistance of the piston spring 25. Only after the pressure on the fluid within the cylinder space 18 has reached a predetermined pressure, determined by the force of free piston spring 25, will the free piston 24 rise above the level of the dispensing bore 23. At this time, liquid under pressure will be dispensed through the dispensing bore 23 and mechanical break-up nozzle 22 under the continuing pressure within the cylinder space 18. In addition, liquid will fill the space beneath the free piston 24.

At the end of the downward stroke of the pump plunger 17, with the parts in the positions as shown in FIG. 2, if the pump plunger is held in the depressed position, the free piston spring 25 will expand, forcing the free piston 24 downwardly through the free piston chamber 21, thereby pumping the liquid within the free piston chamber 21 out through the dispensing bore 23 and nozzle 22 under the desired pressure until the free piston 24 passes the dispensing bore 23, at which point the piston 24 will cut off the spray.

The pump plunger 17 is then released and rises, opening the check valve 15 and drawing liquid into the cylinder space 18.

It will thus be seen that by the simple piston 24 moving back and forth across the end of bore 23, the liquid is not dispensed until a certain pressure has been built up on it, depending on the strength of the free piston spring 25. Further the pressure is maintained until the spray of liquid is cut off. The build up of pressure and cut off of the spray are independent of the speed of actuation of the pump plunger 17, so that the dispensing of properly atomized liquid is not dependent upon proper operation by the user of the atomizer.

The device can be made very simply, since substantially all of the parts, except for the springs and the check valve, can be made of molded plastic, for example polyethylene or polypropylene. The gasket 13*a* can be molded integrally with the upper end of the piston 13, and the free piston 24 can be molded so as to have the lower end thereof in sealing engagement with the interior surface of the piston chamber 21.

It will of course be appreciated that the piston 13 could be on the pump plunger 17 and the cylinder space 18 in the pump body 10.

Figure 3:
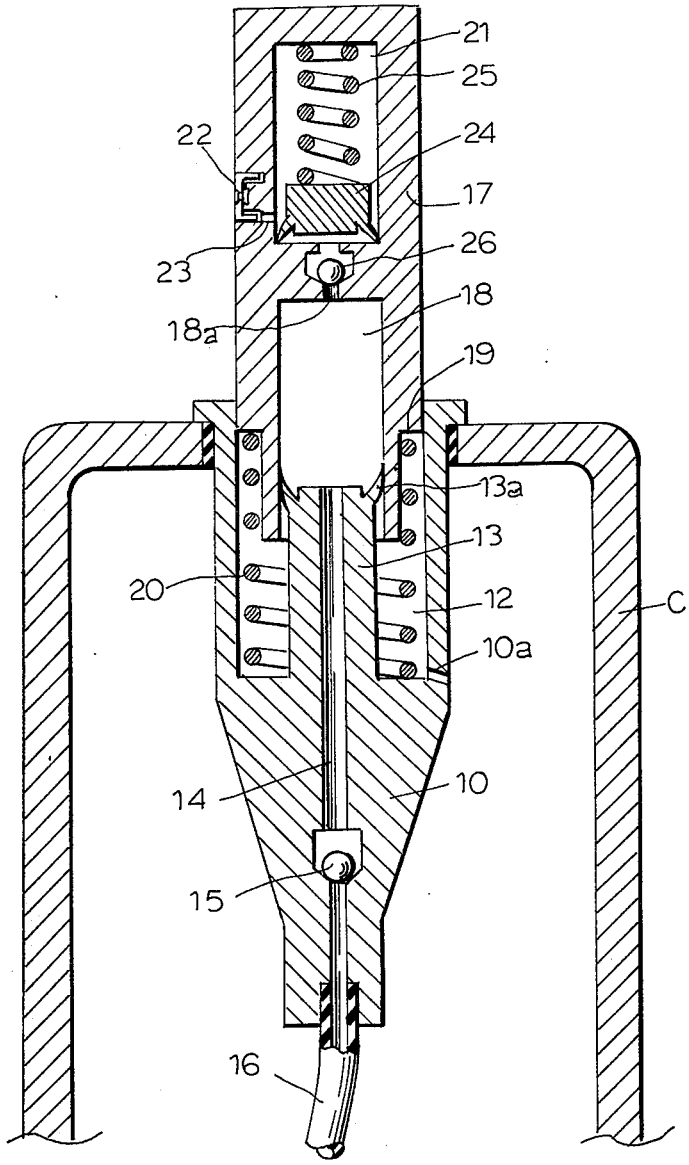
FIG. 3 is a view similar to FIG. 1 of a second embodiment of the finger pump atomizer according to the present invention.

Referring now to FIG. 3, by a simple modification of the embodiment of FIGS. 1 and 2, the apparatus can be made so that it will continue to dispense liquid under pressure for a short time, even after the pumping action on the pump plunger is ended. In the embodiment of FIG. 3, all of the parts are identical with those shown in FIGS. 1 and 2, and in addition, there is provided in the aperture 18*a* between the cylinder space 18 and the free piston chamber 21 a further check valve 26.

The effect of this check valve is to isolate the free piston chamber 21 from the cylinder space 18 at the end of the downward stroke of the pump plunger 17. As will be appreciated, by actuating the pump plunger several times rather quickly, a series of volumes of liquid will be caused to flow past the check valve 26. Only a portion of each of these volumes will be dispensed through bore 23 and nozzle 22 because the bore 23 is smaller than aperture 18*a*, and the remainders will accumulate in the free piston chamber 21. The action of the pump plunger 17 is such as to cause the flow of the liquid past the check valve 26 to be at a greater rate than the flow of the liquid out through the dispensing bore 23 and nozzle 22 during downward movement of the plunger 17. The flow relationships are such that the free piston 24 and spring 25 cause liquid from chamber 21 to continue to be dispensed at least during the time the plunger 17 is returned to its raised or unactuated position by spring 20 and is started to be actuated again. Once this condition is achieved the free piston spring 25 will act on the free piston 24 to continue dispensing of the liquid accumulated in the free piston 21 while the pump plunger 17 is actuated at a somewhat slower speed. The dispensing of this liquid will still be under the pressure exerted on the liquid by the force of the free piston spring 25, so that a good atomization will be obtained.

Thus, by a very simple modification of the already simplified embodiment of FIGS. 1 and 2, the finger pump atomizer can be made to continue to dispense liquid even during the time of the recovery movement of the pump plunger.

In the foregoing embodiment, the free piston movable in the free piston chamber 21 under the effect of the pressurized liquid and the piston spring 25 constitutes a means for storing energy to act on the liquid to be dispensed during the time the pump plunger returns from the actuated position to the unactuated position. In this embodiment, the energy storing means is incorporated in the pump means constituted by the pump plunger 17 and the pump body 10, and the pump plunger is movable vertically downwardly into the container by the finger pressure exerted vertically downwardly.

The same arrangement can, however, be reoriented so that the pump plunger can be actuated by a trigger-like means which can be swung about a horizontal pivot by a squeezing action of the hand pulling the trigger-like element toward the container. Such an arrangement is shown in FIGS. 4 and 5.

Figure 4:
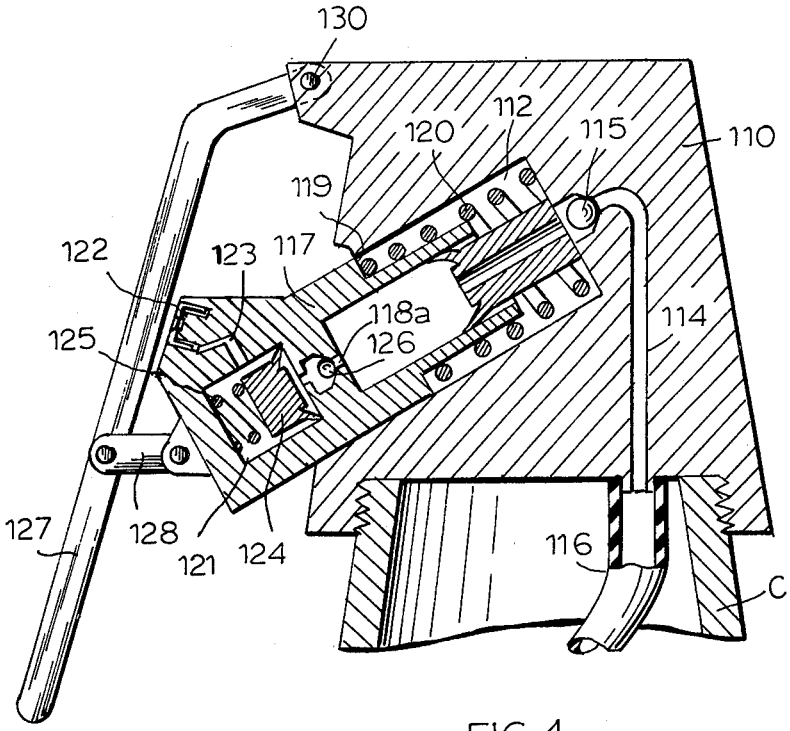
FIG. 4 is a view similar to FIG. 1 of a third embodiment of the finger pump atomizer according to the present invention.
Figure 5:
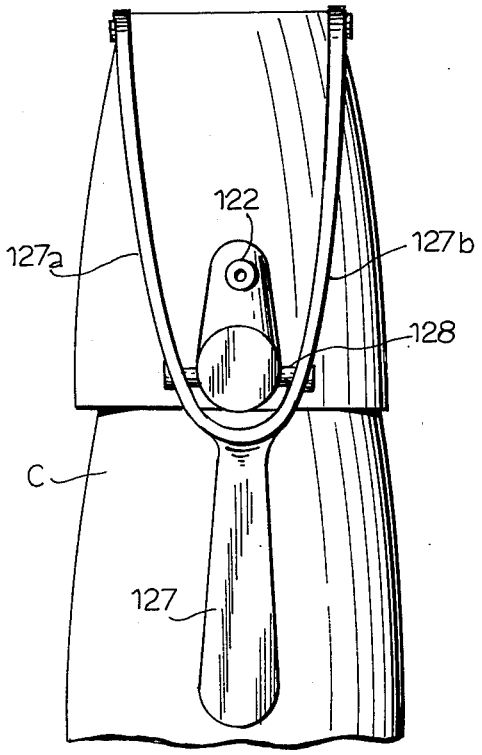
FIG. 5 is a front elevation view of the embodiment of FIG. 4.

In the embodiments of FIGS. 4 and 5, the pump body 110 is shaped in the form of a cap which is threaded onto the container C, and which has a laterally extending hollow recess 112 therein into the bottom of which a piston 113 projects. The piston 113 has a liquid flow bore 114 extending therethrough which further extends through the pump body 110 and opens downwardly into the interior of the container C. A dip tube 116 extends downwardly into the container from the opening of the liquid flow bore 114. A check valve 115 is provided in the liquid flow bore 114.

A pump plunger 117 is slidable laterally into and out of the hollow recess 112 and has a cylinder space 118 therewithin into which the piston 113 fits in sliding engagement to form a piston-cylinder means. A shoulder 119 is provided on the plunger 117 and a return spring 120 is provided between the shoulder 119 and bottom of the hollow recess 112.

A free piston chamber 121 is provided in the outer end of the pump plunger 117, and a mechanical break-up nozzle 122 is provided on the side of the pump plunger 117, to which a dispensing bore 123 extends from the inner end of the free piston chamber 121. A free piston 124 is slidably positioned in the free piston chamber 121, and is urged toward the inner end of the free piston chamber by a free piston spring 125. An aperture 118*a* is provided between the cylinder space 118 and the free piston chamber 121 and a further check valve 126 is provided therein.

Thus far, the structure is identical with the structure of the embodiment of FIG. 2, with the exception that the pump plunger and hollow recess etc. are oriented laterally rather than vertically.

Pivotally mounted on a pin 130 on the upper end of the pump body 110 is a trigger-like lever 127 which extends downwardly along the side of the container C. The outer end of the pump plunger 117 is pivotally linked to the intermediate portion of the trigger-like lever 127 by a link 128 pivotally connected between the pump plunger 117 and the trigger-like lever 127.

It will thus be seen that when the user places his hand around the container C and places his fingers around the side of the trigger-like lever 127 remote from the container, the user can actuate the pump plunger 117 by squeezing the trigger-like lever 127 toward the container and then releasing the trigger-like lever 127. The action of the device will be identical to that described in connection with FIG. 2.

As shown in FIG. 5, it is desirable to have the trigger-like lever 127 a forked lever so that there is space between the branches 127*a* and 127*b* through which the nozzle 122 can be directed to direct the spray of liquid away from the container.

In all of the embodiments thus far, the means for pumping the liquid and the energy storing means have been incorporated in the single pump plunger and piston. However, it is not necessary that the energy storing means and the pump means be combined.

Figure 6:
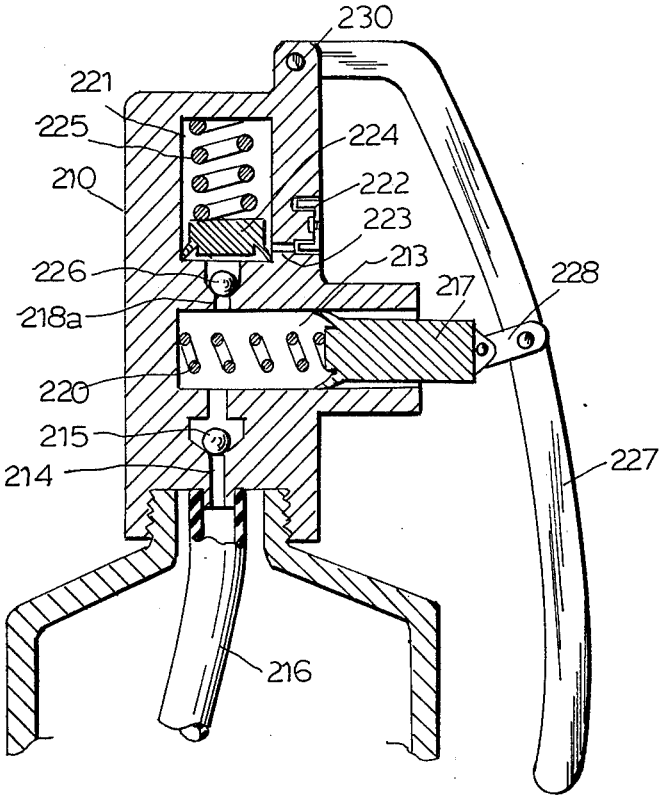
FIG. 6 is a view similar to FIG. 1 of a fourth embodiment of the finger pump atomizer according to the present invention.

As shown in FIG. 6, the dispenser of the present invention can comprise a pump body 210 threadly secured to the neck of a container C, and having a laterally extending hollow recess 212 therein opening out of the side of the body 210. A pump plunger 217 is slidably mounted in the recess 212 to form a piston-cylinder means in combination therewith, and a pump plunger 217 is urged outwardly of the recess 212 by the return spring 220. A liquid flow bore 214 extends from the lower end of the body 210 upwardly into the inner end of the recess 212, and a check valve 215 is provided in this liquid flow bore 214. A dip tube 216 depends from the body 210 at the point where the liquid flow bore 214 opens from the body 210, and extends near the bottom of the container C. The upper end of the body 210 constitutes a dispensing head, and it has a free piston chamber 221 therein, and a dispensing bore 223 opens laterally through the body 210 to a mechanical break-up nozzle 222. The dispensing bore 223 is near the bottom of the free piston chamber 221.

Slidable within the free piston chamber 221 is a free piston 224, urged in the downward direction by a free piston spring 225. An aperture 218*a* opens between the interior of the recess 212 into the free piston chamber 221, and a further check valve 226 is provided in the aperture 218*a*.

A lever 227 is pivotally mounted on a pin 230 on the top of the body 210, and extends downwardly along the side of the container C. The intermediate portion thereof is pivotally linked to the outer end of the pump plunger 217 by a link 228.

The operation of the plunger and free piston in this embodiment is the same as in the embodiment of FIGS. 3 and 4. The user places his hand around the container C with his fingers wrapped around the trigger-like lever 227, and when the trigger-like element 227 is squeezed to move the element toward the container C, the pump plunger 217 is forced into the recess 212. Liquid previously drawn into the recess 212 by the outward movement of the piston 217 is forced past the check valve 226 and into the free piston chamber 221 to raise the free piston 224. When the pressure has built sufficiently to raise the piston 224 past the dispensing bore 223, the dispensing of the spray of liquid begins. When the force of the trigger-like lever 227 is released, the spring 220 urges the piston 217 outwardly of the recess 212, and the force of the spring 225 urging the free piston 224 downwardly causes the liquid beneath the piston 224 to close the check valve 226, and continues to force the liquid through the dispensing bore 223 and out of the nozzle 222 under the pressure of the spring 225. In the meantime, the outward movement of the piston 217 draws liquid from the container through the dip tube 216 and past the check valve 215 into the recess 212.

By quickly repeating the squeezing action to quickly pump the piston 217 several times, sufficient liquid can be accumulated in the free piston chamber so that the device will continue to dispense a spray of liquid during the recovery time which it takes for the spring 220 to move the piston 217 to its outermost position and the user can again start actuation of the trigger-like element 227. The device of this embodiment will thus continue to produce a spray even when the trigger-like element is released and allowed to return to its starting position and then actuated again.

In the foregoing embodiment, the pump plunger 217 and the free piston 224 are incorporated in a single structure 210 which constitutes the pump body and the dispensing head and which is mounted on the top of the container. This is convenient for manufacturing purposes and enables the manufacturer of the dispensing means to supply just the dispensing means to packagers who are packaging material to be dispensed in containers C.

However, it is not necessary that all of the elements of the dispenser be incorporated in a single body.

Figure 7:
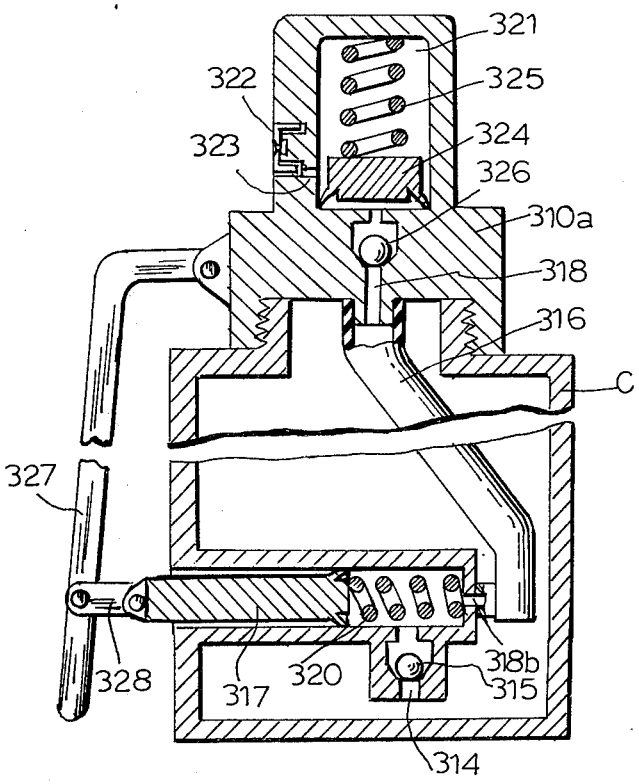
FIG. 7 is a view similar to FIG. 1 of a fifth embodiment of the finger pump atomizer according to the present invention.

As shown in the embodiment of FIG. 7, the dispenser comprises a container C in the lower portion of which is provided a pump body 310 having a recess 312 therein into which a pump plunger 317 is slidable to form a piston-cylinder means with the pump body 310. A return spring 320 urges the pump plunger 317 outwardly of the recess 312. A liquid flow bore 314 is provided through the pump body 310 into the inner end of the recess 312, and a check valve 315 is provided in the liquid flow bore 314.

Mounted on the neck of the container in screw-threaded fashion is a dispensing head 310*a* within which is a free piston chamber 321 having a dispensing bore 323 opening laterally thereof to a mechanical break-up nozzle 322. A free piston 324 is slidable in the free piston chamber 321, and is urged toward the lower end thereof by a free piston spring 325. An aperture 318*a* is provided between the lower end of the free piston chamber 321 and the bottom of the dispenser body 310*a*, in which aperture is a further dispensing valve 326. A tube 316 extends between the dispenser body 310*a* where the aperture 318*a* opens out of the bottom thereof to a further aperture 318*b* in the inner end of the pump body 310.

Trigger-like lever 327 is pivoted to the dispenser body 310*a*, and extends downwardly along the side of the container C, and is pivotally linked to the outer end of the pump plunger 317 by a link 328.

The operation of this embodiment is the same as that of the embodiment of FIG. 6, the actuation of the trigger-like lever 327 moving the pump plunger 317 into the recess 312 to force liquid through the tube 316 past the check valve 326 into the free piston chamber 321 against the action of the spring 325 working on the free piston 324. Upon release of the trigger-like lever 327, the check valve 326 will close and dispensing of the liquid will continue under the action of the spring 325 and piston 324 while the spring 320 returns the pump plunger 317 to its initial position, drawing liquid from within the container C through the bore 314 past the check valve 315 to fill the space 312.

It will thus be seen that in its broadest aspect, the present invention involves providing means for pumping liquid from the container under pressure to an energy storage means in which the liquid under pressure is stored and from which it is dispensed under a pressure independent of the force with which the pump means is actuated. By providing the additional check valve, the dispenser means can be made to continue to dispense liquid under the desired pressure while the pump means recovers to its initial position and is reactuated to start pumping the liquid to the energy storing means once more.

What is claimed is:

1. A pump type dispenser for dispensing a spray of liquid, comprising a container for containing the liquid to be dispensed, a pump body member mounted on said container, a pump plunger member movable relative to said pump body member into and out of said pump body, one end of said pump plunger member and said pump body member cooperating to define therebetween a piston-cylinder means, a spring means between said members urging them apart, said pump body member having a liquid flow path therethrough having one end communicating with the container and the other end communicating with the piston-cylinder means, a check valve in said liquid flow path for blocking flow of liquid in said liquid flow path in the direction toward said container, a dispensing head integral with said pump body member and having a free piston chamber therein, a pressurized liquid flow path from said piston-cylinder means into one end of said free piston chamber, a further check valve in said pressurized liquid flow path for blocking flow of liquid in the direction toward the piston-cylinder means, a free piston slidable in said free piston chamber, a free piston spring in said free piston chamber urging said free piston toward and into engagement with said one end of said free piston chamber, and nozzle means opening out of said free piston chamber through said dispensing head member from a position just above said one end of said free piston chamber, said free piston in the position in engagement with said one end of the free piston chamber obturating the fluid flow between said pressurized liquid flow path nozzle means.

2. A pump type dispenser for dispensing a spray of liquid, said dispenser being for mounting on a container for containing the liquid to be dispensed, said dispenser comprising a pump body member, a pump plunger member movable into and out of said pump body member, one end of said pump plunger member and said pump body member cooperating to define therebetween a piston-cylinder means, spring means between said members urging them apart, said pump body member having a liquid flow path therethrough having one end communicating with the container and the other end communicating with the piston-cylinder means, a check valve in said liquid flow path for blocking flow of liquid in said liquid flow path in the direction toward said container, a dispensing head integral with said pump body and having a free piston chamber therein, a pressurized liquid flow path from said piston-cylinder means into one end of said free piston chamber, a further check valve in said pressurized liquid flow path for blocking flow of liquid in the direction toward the piston-cylinder means, a free piston slidable in said free piston chamber, a free piston spring in said free piston chamber urging said free piston toward and into engagement with said one end of said free piston chamber, and nozzle means opening out of said free piston chamber through said dispensing head member from a position just above said one end of said free piston chamber, said free piston in the position in engagement with said one end of the free piston chamber obturating the fluid flow between said pressurized liquid flow path nozzle means.

* * * * *